US010456617B1

(12) United States Patent
Allison

(10) Patent No.: US 10,456,617 B1
(45) Date of Patent: Oct. 29, 2019

(54) ROCKER EXERCISE APPARATUS WITH ENHANCED STABILITY AND USER SAFETY

(71) Applicant: Joseph Adam Allison, Redondo Beach, CA (US)

(72) Inventor: Joseph Adam Allison, Redondo Beach, CA (US)

( * ) Notice: Subject to any disclaimer, the term of this patent is extended or adjusted under 35 U.S.C. 154(b) by 39 days.

(21) Appl. No.: 15/630,752

(22) Filed: Jun. 22, 2017

Related U.S. Application Data

(60) Provisional application No. 62/427,610, filed on Nov. 29, 2016.

(51) Int. Cl.
*A63B 22/16* (2006.01)
*A63B 21/00* (2006.01)

(52) U.S. Cl.
CPC ..... *A63B 22/16* (2013.01); *A63B 21/0004* (2013.01)

(58) Field of Classification Search
CPC ..... A63B 22/16; A63B 22/18; A63B 21/0004; A63B 21/00178; A63B 21/00047
See application file for complete search history.

(56) References Cited

U.S. PATENT DOCUMENTS 3,475,020 A * 10/1969 Schauerte ..... A63B 22/16 482/146
5,496,248 A * 3/1996 Batscher ..... A63B 21/0004 482/146
5,692,996 A 12/1997 Wideman
6,916,276 B1 * 7/2005 Robinson ..... A63B 22/16 482/147
7,563,216 B1 * 7/2009 Kest ..... A63B 22/16 482/140
D712,987 S 9/2014 Salzedo
9,220,944 B2 * 12/2015 Moscarello ..... A63B 26/003
2008/0176724 A1 * 7/2008 Chrysanthus ..... A63B 21/0728 482/107
2016/0082307 A1 3/2016 Wideman
2017/0273848 A1 * 9/2017 Polonen ..... A61H 1/003

OTHER PUBLICATIONS

BTK Body Rocker, Nov. 15, 2016, pp. 1-2, available at https://web.archive.org/web/20161115113722/http://www.btksport.com:80/btk-body-rocker/.
2) BTK Body Rocker, Jun. 8, 2017, pp. 1-2, available at http://www.btksport.com/btk-body-rocker/.

* cited by examiner

*Primary Examiner* — Megan Anderson
(74) *Attorney, Agent, or Firm* — Plager Schack LLP; Mark H. Plager; Eric Liou

(57) ABSTRACT

An exercise apparatus designed to rock on a ground surface and support a user in one of a plurality of positions with enhanced stability and user safety is provided. The exercise apparatus includes a pair of side plates coupled together by a plurality of rods and disposed on the ground surface, each side plate having an upper surface with a concave shape and a lower surface having a convex shape that contacts the ground surface and permits a lateral rocking movement of the side plate, the lower surface of each side plate having a pair of fins extending from opposing ends toward the ground surface. The user grabs any number of the plurality of rods to maneuver the side plates within the permitted range of lateral movement, thereby enabling the user to perform the variety of exercises in the plurality of supported positions.

8 Claims, 4 Drawing Sheets

ROCKER EXERCISE APPARATUS WITH ENHANCED STABILITY AND USER SAFETY

RELATED APPLICATION

The application claims priority to provisional patent application U.S. Ser. No. 62/427,610 filed on Nov. 29, 2016, the entire contents of which is herein incorporated by reference.

BACKGROUND

The embodiments herein relate generally to exercise devices to help an individual to develop, maintain and/or build muscle mass, strength and endurance.

Individuals continually seek different exercises and workout routines to aid in the development of increased muscle strength and endurance. With the busy lives of individuals and limited free time available, there is a need for a device and exercise routine that can efficiently target multiple muscle groups at the same time including, but not limited to, the chest, shoulder, core and stability muscles. There is also a demand for portable exercise devices that can be used at the convenience of a home or location with limited available space. This saves the user travel time to a gym and the associated costs.

A variety of portable exercise devices exist as disclosed in U.S. D712,987, U.S. Patent Application Publication 2016/0082307 and U.S. Pat. No. 5,692,996. These exercise devices permit the user to perform a variety of pushing movements on the ground, curling and/or overhead exercises. However, these devices have a limited number of hand positions on the device available to the user, which limits the range of motion and/or engagement of muscles when performing the exercises.

The BTK Body Rocker is an exercise device that rocks on the ground laterally and provides the user with various hand gripping handles to perform movements. Although this device provides a greater range of motion and muscle engagement of different body areas compared to other tools, this device can be unsafe for the user. In particular, the device does not limit the range of lateral rocking permitted by the device. If the user grabs one of the outermost handles and rocks the device laterally in that direction, the user's knuckle and hand can be driven into the ground. This contact can result in serious injuries to the user's knuckles and/or hand.

As such, there is a need in the industry for a rocker exercise apparatus with enhanced stability and user safety that addresses the limitations of the prior art, which effectively aids a user to efficiently engage muscles in different target regions including the chest, shoulder, core and stability muscles.

SUMMARY

An exercise apparatus configured to rock on a ground surface and support a user in one of a plurality of positions with enhanced stability and user safety is provided. The exercise apparatus is configured to enable the user to perform a variety of exercises in any one of the plurality of positions. The exercise apparatus comprises a pair of side plates coupled together by a plurality of rods and configured to be disposed on the ground surface, each side plate in the pair of side plates comprising an upper surface comprising a concave shape and a lower surface comprising a convex shape configured to contact the ground surface and permit a lateral rocking movement of the side plate, the lower surface of each side plate comprising a pair of fins extending from opposing ends of the lower surface toward the ground surface, each fin configured to contact the ground surface to limit a range of lateral rocking movement permitted by the side plate, wherein the user is configured to grab any number of the plurality of rods to maneuver the pair of side plates within the permitted range of lateral movement, thereby enabling the user to perform the variety of exercises in the plurality of supported positions.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
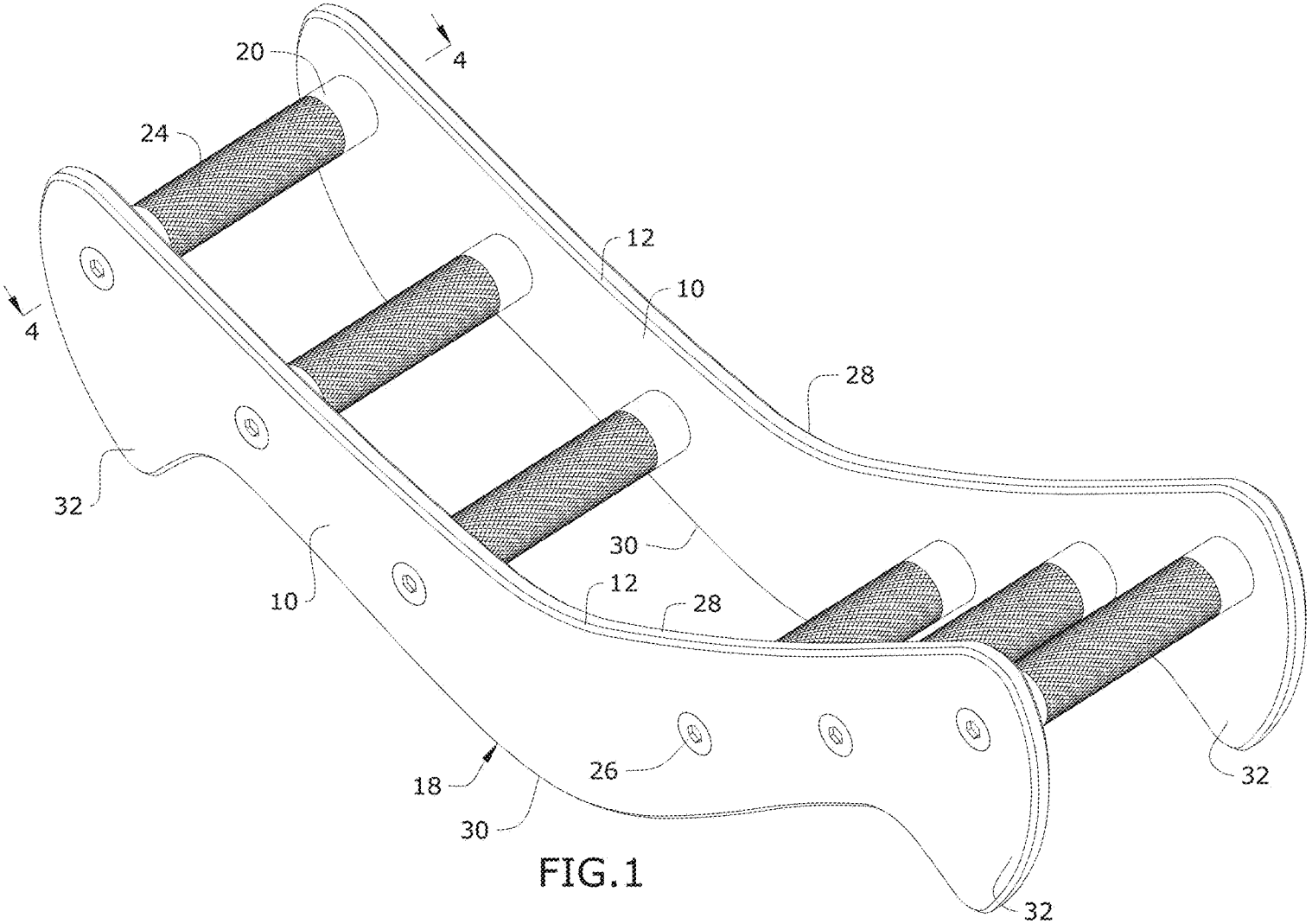
FIG. 1 depicts a top perspective view of certain embodiments of the exercise apparatus.
Figure 2:
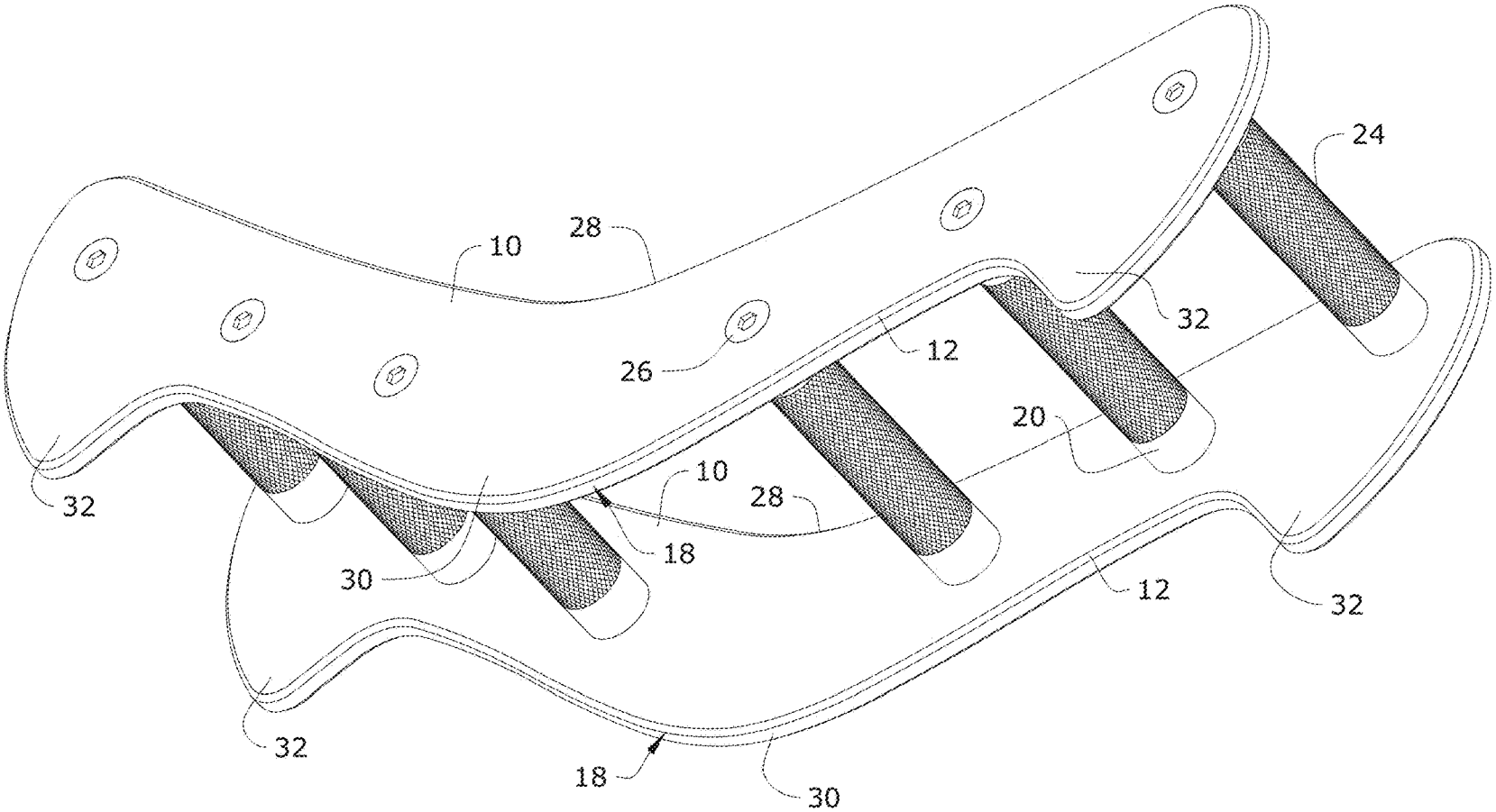
FIG. 2 depicts a bottom perspective view of certain embodiments of the exercise apparatus.
Figure 3:
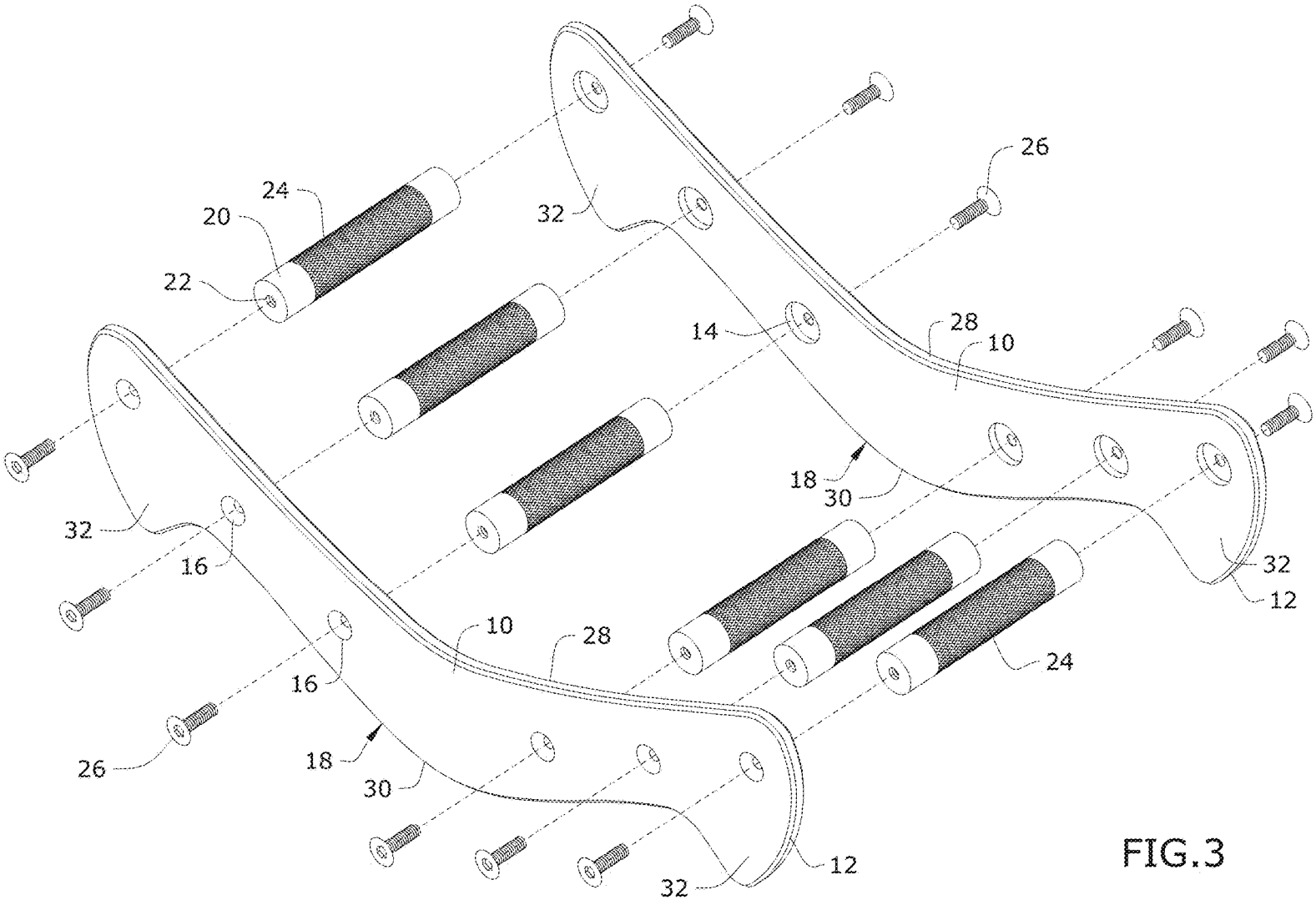
FIG. 3 depicts an exploded view of certain embodiments of the exercise apparatus.

As depicted in FIGS. 1-3, the exercise apparatus is a portable tool configured for use by a user to perform a variety of exercises. The exercise apparatus is configured to rock laterally on a surface such as the ground to enable the user to perform the variety of exercises in variable positions. This helps the user to improve strength and endurance in different muscle groups including, but not limited to, the chest, shoulders, abs, core and stability muscles. The variety of exercises performed using the exercise apparatus include push-ups, planks, and the like. In certain embodiments, the exercise apparatus is used to perform other exercises such as curls or overhead presses. It shall be appreciated that the exercise apparatus has a weight of approximately 15 lbs and is configured to support a user with a weight of up to approximately 400 lbs.

In certain embodiments, the exercise apparatus generally comprises a pair of side plates 10 oriented generally parallel to each other and coupled together by rods 20 and fasteners 26. The exercise apparatus preferably is made from aluminum. However, alternative metals or other materials known in the field may be used instead.

Each side plate 10 comprises upper concave surface 28, lower convex surface 30, lower fins 32 and a plurality of holes. Each hole in side plate 10 is formed by countersunk hole 16 and slot 14. In a preferred embodiment, each side plate 10 comprises approximate dimensions of a 8" height, 24" length and ½" thickness. However, side plate 10 may have alternative dimensions.

The center of lower convex surface 30 comprises rocker surface 18, which is configured to contact the ground (not shown) and permit lateral rocking movement of side plate 10 on the ground. Lower fins 32 extend from opposing ends of the lower surface of side plate 10 toward the ground. Each lower fin 32 is configured to contact the ground upon continued lateral rocking of side plate 10 in a particular direction. This limits the range of lateral rocking movement permitted by side plate 10. In one embodiment, the entire outer edge of side plate 10 comprises beveled edge 12.

Figure 4:
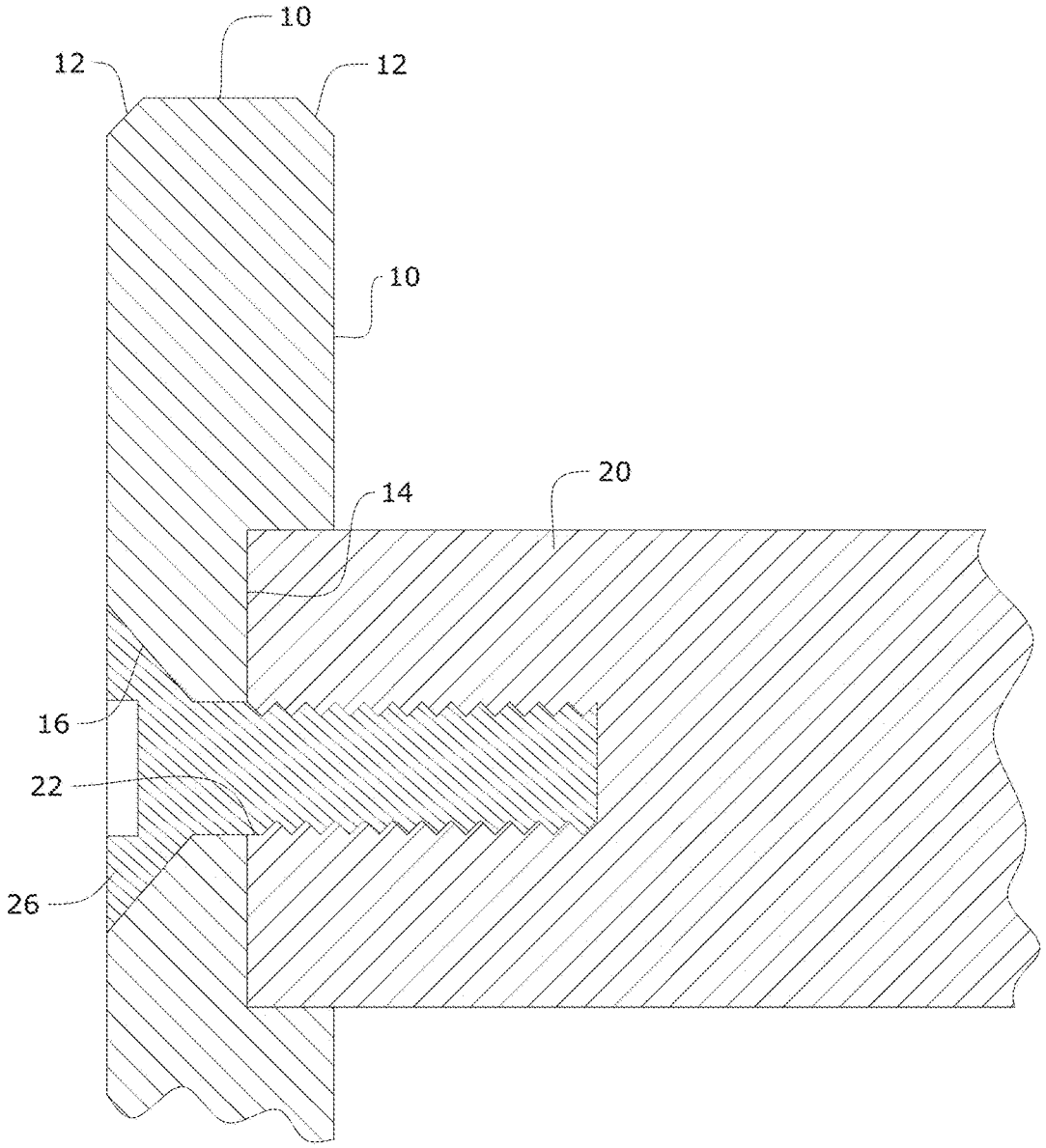
FIG. 4 depicts a section view of certain embodiments of the exercise apparatus taken along line 4-4 in FIG. 1.

The pair of side plates 10 are oriented generally parallel to each other to align corresponding slots 14 and countersunk holes 16 of both side plates 10 together. As depicted in FIGS. 3-4, the ends of each rod 20 are disposed in slots 14 of side plates 10. For each side plate 10, fastener 20 is inserted within countersunk hole 16 of side plate 10 and threaded hole 22 of rod 20. This secures the end of rod 20 to side plate 10. Fastener 20 is preferably a stainless steel screw that comprises a head portion that rests against countersunk hole 16 of side plate 10. This permits each rod 20 to be securely fastened to both side plates 10. In one embodiment, fastener 20 is a screw that comprises approximate dimensions of 1" in length and ⅜" in diameter.

In one embodiment, each rod 20 comprises knurled outer surface 24 that enhances grip between the user's hand and rod 20. In a preferred embodiment, each rod 20 comprises an approximate length of 7" and diameter of 1⅜". Although the figures depict six rods 20 coupled to side plates 10, it shall be appreciated that any alternative number of rods 20 may be used instead.

In operation, the user disposes the exercise apparatus on the ground so that rocker surfaces 18 of side plates 10 contact the ground. The user grabs any number of rods 20 to rock the exercise apparatus 10 laterally on the ground to perform exercises such as push-ups, planks, or other movements. The user can grab different rods 20 and rock the exercise apparatus to a desired position to vary the engagement of muscles used when performing the exercises. If the user grabs any one of the outer rods 20, the corresponding lower fins 32 of side plates 10 are configured to contact the ground to limit lateral rocking of the exercise apparatus. This prevents the user's knuckles or hand from contacting the ground, thereby enhancing user safety. In an alternative embodiment, the user can perform alternative movements with the exercise apparatus such as arm curls or overhead presses.

It shall be appreciated that the components of the exercise apparatus described in several embodiments herein may comprise any alternative known materials in the field and be of any color, size and/or dimensions. It shall be appreciated that the components of the exercise apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An exercise apparatus configured to rock on a ground surface and support a user in a plurality of positions with enhanced stability and user safety, the exercise apparatus configured to enable the user to perform a variety of exercises in any one of the plurality of positions, the exercise apparatus comprising:

a pair of side plates coupled together by a plurality of rods and configured to be disposed on the ground surface, the plurality of rods positioned throughout the pair of side plates with a first pair of rods in the plurality of rods located proximate first end portions of the pair of side plates and a second pair of rods in the plurality of rods located proximate second end portions of the pair of side plates, each side plate in the pair of side plates comprising an upper surface having a concave shape and a lower surface having a convex shape configured to contact the ground surface and permit a lateral rocking movement of the respective side plate of the pair of side plates, the lower surface of each side plate of the pair of side plates comprising a pair of fins extending from opposing ends of the lower surface toward the ground surface, a first fin in the pair of fins converging to a first point beneath and between the first pair of rods and a second fin in the pair of fins converging to a second point beneath and between the second pair of rods, the first point or second point in each of the pair of fins pointing towards the ground surface and configured to contact the ground surface to limit a range of the lateral rocking movement permitted by the respective side plate of the pair of side plates;

wherein the user is configured to grab any number of the plurality of rods to maneuver the pair of side plates within the range of the lateral rocking movement, thereby enabling the user to perform the variety of exercises in the plurality of positions.

2. The exercise apparatus of claim 1, wherein each rod in the plurality of rods comprises a knurled outer surface.

3. The exercise apparatus of claim 2, wherein each side plate in the pair of side plates comprises a plurality of countersunk holes disposed therethrough.

4. The exercise apparatus of claim 3, further comprising a first set of screws disposed through the plurality of countersunk holes in a first side plate in the pair of side plates to secure the first side plate to first ends of the plurality of rods and a second set of screws disposed through the plurality of countersunk holes in a second side plate in the pair of side plates to secure the second side plate to second ends of the plurality of rods.

5. The exercise apparatus of claim 4, wherein each plate in the pair of side plates comprises a beveled outer edge.

6. An exercise apparatus configured to rock on a ground surface and support a user in a plurality of positions with enhanced stability and user safety, the exercise apparatus configured to enable the user to perform a variety of exercises in any one of the plurality of positions, the exercise apparatus comprising:

a pair of side plates coupled together by a plurality of rods and configured to be disposed on the ground surface, the plurality of rods positioned throughout the pair of side plates with a first pair of rods in the plurality of rods located proximate first end portions of the pair of side plates and a second pair of rods in the plurality of rods located proximate second end portions of the pair of side plates, each side plate in the pair of side plates comprising an upper surface having a concave shape and a lower surface having a convex shape in a central portion of the lower surface that is configured to contact the ground surface and permit a lateral rocking movement of the respective side plate of the pair of side plates, the lower surface of each side plate of the pair of side plates comprising a pair of fins extending from opposing ends of the lower surface toward the ground surface, a first fin in the pair of fins comprising a triangular shape that converges to a first point beneath and between the first pair of rods and a second fin in the pair of fins comprising a triangular shape that converges to a second point beneath and between the second pair of rods, the first point or second point in each of the pair of fins pointing towards the ground surface and configured to contact the ground surface to limit a range of the lateral rocking movement permitted by the respective side plate of the pair of side plates;

wherein the user is configured to grab any number of the plurality of rods to maneuver the pair of side plates within the permitted range of the lateral rocking movement, thereby enabling the user to perform the variety of exercises in the plurality of supported positions.

7. The exercise apparatus of claim 6, wherein each fin in the pair of fins in each side plate in the pair of side plates forms a concave portion in the lower surface of the side plate between the fin and the central portion of the lower surface of the side plate.

8. The exercise apparatus of claim 7, wherein the fins in the pair of side plates are sufficiently sized and configured to support the user on the apparatus in a stable position with the first fins in the pair of side plates or the second fins in the pair of side plates in contact with the ground surface.

* * * * *